United States Patent [19]

Al-Shaikh et al.

[11] 4,056,714

[45] Nov. 1, 1977

[54] METHOD FOR CONTROL OF CEILING TILE PROCESS

[75] Inventors: Al Al-Shaikh, Sunnyvale; Erik B. Dahlin, Saratoga, both of Calif.

[73] Assignee: Measurex Corporation, Cupertino, Calif.

[21] Appl. No.: 648,656

[22] Filed: Jan. 13, 1976

Related U.S. Application Data

[63] Continuation of Ser. No. 495,565, Aug. 8, 1974, abandoned.

[51] Int. Cl.[2] ..... D21F 11/00

[52] U.S. Cl. ..... 364/111; 162/198; 364/469; 364/568

[58] Field of Search ..... 235/151.1; 162/198, 162/DIG. 10, DIG. 11

[56] References Cited

U.S. PATENT DOCUMENTS

| | | | |
|---|---|---|---|
| 3,564,224 | 2/1971 | Chope | 235/151.35 |
| 3,634,187 | 1/1972 | Chari et al. | 162/198 |
| 3,711,687 | 1/1973 | Stout et al. | 162/DIG. 11 X |
| 3,801,426 | 4/1974 | Putman et al. | 162/198 |

*Primary Examiner*—Eugene G. Botz

*Attorney, Agent, or Firm*—Flehr, Hohbach, Test, Albritton & Herbert

[57] ABSTRACT

A process for controlling the dry density of ceiling tile where a delayed measurement of thickness or caliper is compared with an off-line oven dry basis weight measurement of a previously taken sample to provide dry density which is then compared to a dry density target to yield an error signal which updates an on-line wet density indication to provide control of stock flow.

2 Claims, 1 Drawing Figure

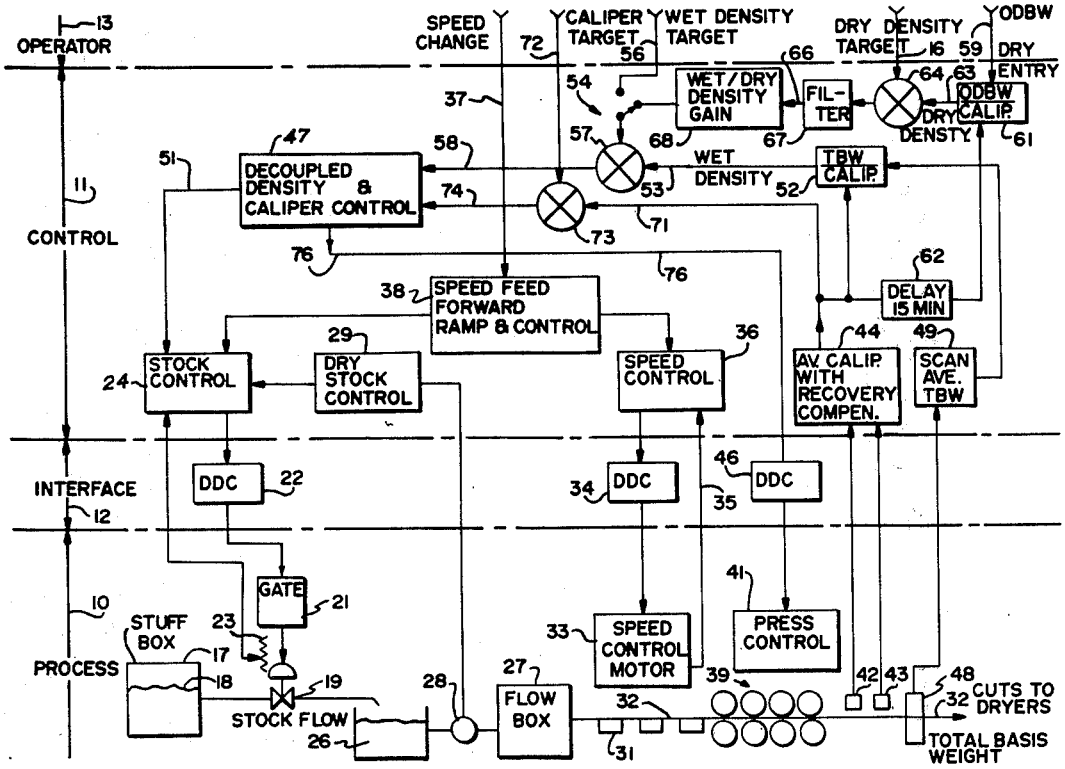

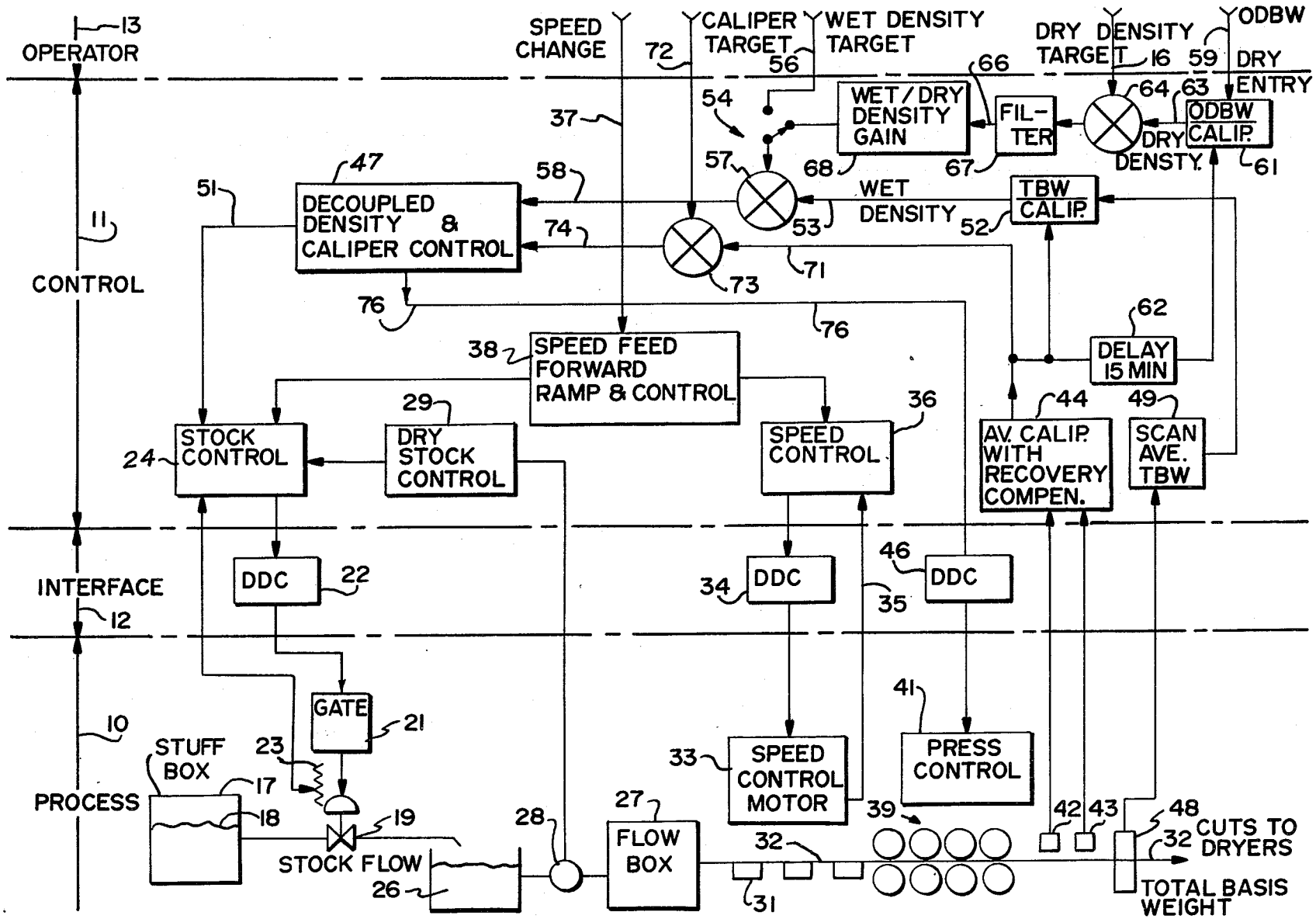
ODBW
DRY ENTRY
DRY DENSITY TARGET
WET DENSITY TARGET
CALIPER TARGET
SPEED CHANGE
ODBW CALIP.
DRY DENSTY.
FIL-TER
WET/DRY DENSITY GAIN
TBW CALIP.
WET DENSITY
DELAY 15 MIN
SCAN AVE. TBW
AV. CALIP. WITH RECOVERY COMPEN.
DDC
PRESS CONTROL
SPEED CONTROL
SPEED CONTROL MOTOR
SPEED FEED FORWARD RAMP & CONTROL
DECOUPLED DENSITY & CALIPER CONTROL
DRY STOCK CONTROL
STOCK CONTROL
GATE
FLOW BOX
STUFF BOX
STOCK FLOW
CUTS TO DRYERS
TOTAL BASIS WEIGHT
OPERATOR
CONTROL
INTERFACE
PROCESS

METHOD FOR CONTROL OF CEILING TILE PROCESS

This is a continuation, of application Ser. No. 495,565, filed August 8, 1974, now abandoned.

BACKGROUND OF THE INVENTION

The present invention is directed to a method for the control of the oven dry density of a moving sheet material and more specifically to the density of ceiling tile.

In the manufacture of ceiling tile it is not possible to make on-line measurement of its moisture content. Thus, the final density after being cut and passed through dryers, known as the oven dry density, is normally estimated. Density is, of course, the total basis weight divided by the thickness of caliper of the ceiling tile.

The two parameters for control of ceiling tile are the stuff gate which is in essence the stock flow of raw material to the headbox and the press which is the force used to control the thickness. In the past, manual control of these two parameters was used to produce the final desired dry density. Specifically, this was accomplished every 30 minutes by the machine tender who took a caliper or thickness reading automatically or with a hand gauge and a standard size sample. The wet weight was measured and it was then dried in a microwave oven and the dry weight measured. With this data, the machine tender calculated an estimated dry density which is an estimate of the product density after leaving the dryer. The estimated dry density was then compared to the desired or target dry density and either the stuff gate and/or the press parameters were controlled accordingly. With the foregoing manual control method, the final dry density and concommitant caliper or thickness varied excessively. For example, estimated dry density might vary by more than two pounds per cubic feet and caliper by more than 0.010 inches.

OBJECTS AND SUMMARY OF THE INVENTION

It is, therefore, an object of the present invention to provide a control system for the manufacture of moving sheet material where on-line measurement of moisture is not feasible which has improved automatic control of dry density of the material.

In accordance with the above object, there is provided a method for the control of oven dry density of a moving sheet material where the on-line measurement of moisture before said sheet material is dried is not feasible due to the type of sheet material being manufactured. The total basis weight of the material is measured along with the thickness of the material. The ratio of the basis weight and thickness provide the wet density of the material. The wet density is utilized in a feedback control loop to control the density to a target. A sample of the wet material is obtained and dried in a manner equivalent to the oven drying of the sheet material, and the oven dry density of the material is obtained by division with a thickness measurement taken substantially at the time the sample was taken. The oven dry density of the sample is compared with a predetermined dry density target to produce an error signal. The error signal is utilized to update the wet density in a manner to achieve the dry density target.

BRIEF DESCRIPTION OF THE DRAWING

The single FIGURE shows a block diagram embodying the present invention.

DETAILED DESCRIPTION OF THE PREFERRED EMBODIMENT

The drawing is divided as indicated into an actual process portion 10 of a machine for producing ceiling tile, a control portion 11 for controlling various parameters of the ceiling tile machine, an interface portion 12 coupling the process and control portions and an operator portion 13 where the operator or machine handler inputs several parameters. One such parameter as indicated on line 16 is the dry density target. Specifically, this target is the final product parameter of the ceiling tile which it is desired to closely control. Such dry density is in terms of the total basis weight or weight per unit area of the ceiling tile divided by its thickness or as it is termed in the ceiling tile art the caliper.

In general, referring to the process portion 10 of the FIGURE, the raw material for the process is supplied to a stuff box 17 which is maintained at a constant level or head indicated at 18. The rate of material flow out of the stuff box is regulated by stock flow valve or stuff gate 19 controlled by a gate motor 21. The motor 21 is driven by direct digital control unit 22 in the interface portion 12. Feedback of the position of the stock flow valve 19 is provided by the schematically indicated potentiometer 23 to a stock control process unit 24. Such feedback is necessary since there is no accurate method of directly measuring stock flow. However a flowmeter, if available, would be preferable.

A headbox 26 receives the raw material which is directly pumped to a flow box 27. Its consistency at this point is measured by consistency meter 28 which is coupled to a dry stock control unit 29 whose output in turn controls stock unit 24. This is a minor feedback control loop.

The ceiling tile material from flow box 27 is actually formed into a flat moving sheet parallelled felt belts (not shown but well known in the art) as indicated at 31 to form the moving sheet 32. The speed of the sheet is regulated by speed control motor 33, which includes direct digital control unit 34, and a feedback speed indication on line 35 to a speed control unit 36. Speed changes are inputed via the operator to line 37 through a speed feedforward ramp and control unit 38. This unit is coupled both to the control unit 36 and to stock control unit 24 to provide for anticipation of speed control changes. In other words, if speed is increased, to maintain the same basis weight stock flow must be increased by stock control unit 24.

After water is drained from moving sheet 32 it is pressed to a desired thickness by press rollers 39 whose speed is controlled by the speed control motor 33 and whose loading is controlled by press control 41. Loading determines, of course, the caliper or thickness of the sheet material. Such thickness is measured by front side and back side caliper units 42 and 43, respectively. These caliper units are well-known in the art and may employ wheels which are running on the moving sheet. Caliper information is coupled to the computing unit 44 which averages the two caliper readings and also includes recovery compensation. This is a grade dependent factor and is related to the expansion of the ceiling tile material after being oven dried.

The press control unit 41 is directly controlled by direct digital control unit 46 which in turn is connected by the line 76 to decoupled density and caliper control unit 47.

Still referring to the actual ceiling tile machine, after the caliper is measured the total basis weight (TBW) is measured by gauge 48 which may be any suitable basis weight gauge such as that used in paper making machine technology. The output of gate 48 is averaged by the scan average total basis weight unit 49. The moving ceiling tile sheet 32 is then cut into sections and dried in ovens before being packed for shipment.

All of the foregoing process for producing ceiling tile is well-known in the art except that the control for stock, speed and press have been essentially accomplished by manual means; in other words, by the machine tender.

In general, control of a ceiling tile process is difficult since because of the great thickness of the tile, there is no practical technique for on-line measurement of moisture. Thus, where it is desired to accurately control a parameter such as the final dry density it is difficult since the wet density which is measured and is theoretically available for feedback control has an an unknown component of moisture in it. In other words, the proportion of actual dry material and moisture may vary between the two of them and yet provide a constant total for basis weight reading. Thus, feedback control with the mere use of a wet density target is insufficient.

However, in accordance with the invention, such a basic feedback loop is provided by the line 51 from the control stock unit 24 which is provided a control signal by the decoupled density and caliper control unit 47. Wet density is provided by dividing the total basis weight output of unit 49 by the caliper from unit 44 in division unit 52 to provide a wet density indication on line 53. In the start up mode a switch 54 couples the wet density target input on line 56 to comparison unit 57 to provide on line 58 a feedback error signal. As discussed above, such feedback while better than manual control is still highly inaccurate.

In accordance with the invention, the wet density output on line 53 is biased or updated to in effect compensate for the absolute moisture content by the following technique.

A sample of the sheet material 32 is obtained at periodic intervals of, for example, 15 or 30 minutes, and dried by the machine tender in a microwave oven in a manner equivalent to the oven drying of the cuts of the ceiling tile material. The oven dried basis weight (ODBW) is then measured off-line and inputed via line 59 at an exact time interval. The division unit 61 then divides the oven dried basis weight by the caliper reading which is a thickness measurement taken substantially at the same time that the sample was obtained. This is accomplished by providing delay unit 62 where the same, for example 15 minute, time delay matches the thickness with the sample. Division unit 61 thus provides a dry density on line 63 which is coupled to a comparator 64 to be compared with the dry density target input. On line 66 an error signal is coupled through a smoothing filter 67 to the wet/dry density gain unit 68. At this time the initial startup of the machine, switch 54 is moved to the position indicated so that the output of the wet/dry density gain unit 68 serves to update via comparator 57 the wet density signal on line 53. This updating is accomplished in a manner to cause the feedback control loop to reduce the error and thus cause changes in the stock flow in a manner to achieve the dry density target. The smoothing filtering 67 provides only for long term control actions immunizing the system against short term variations. This is important because of the input of new information every 15 minutes or 30 minutes of the oven dry basis weight. The control system by its nature can be responsive only to long term drifts. However, in the production of ceiling tile the actual system is relatively stable and for accurate control of the final dry density parameter requires only long term corrections. The wet dry density gain unit 68 includes gain constants relating the stock flow both to caliper and density and relating press control to caliper and density.

The control output on line 51 is an output of the present move to be made which is determined by the previous move multiplied by a constant factor related to speed and time plus the error input on line 58 multiplied by the wet/dry gain constant and speed and time constants.

Feedback caliper control is provided on line 71 in which the present caliper value is compared with the caliper target input 72 by comparator 73 and an error signal on line 74 is connected to control unit 47 for control which is coupled on line 76 to direct digital control unit 46.

Density and caliper control are decoupled by techniques well known in the art so that a variation of, for example, caliper where greater pressure is applied for thinner material will reduce the stock flow to maintain the same basis weight. Similarly, if a control move for greater stock flow is indicated, thus increasing density and basis weight, greater pressure will be provided to maintain constant caliper.

Thus, the present has provided an improved automatic control technique for dry density control of materials such as ceiling tile where on-line moisture measurement is not possible.

We claim:

1. A method for the control of oven dry density of a moving sheet material where the on-line measurement of moisture before said sheet material is dried is not feasible due to the type of sheet material being manufactured said method comprising the following steps: measuring the total basis weight of said material; measuring the thickness of said material, the ratio of basis weight and thickness providing the wet density of said material; utilizing said wet density in a feedback control loop to control such density to a target; obtaining a sample of wet material; drying such sample in a manner equivalent to the oven drying of said sheet material, obtaining the oven dry density of said material by division with a thickness measurement taken substantially at the time said sample was obtained; compared said oven dry density of said sample with a predetermined dry density target to produce an error signal; and utilizing said error signal to update said wet density in a manner to achieve said dry density target.

2. A method as in claim 1 including the step of smoothing filtering said error signal.

* * * * *